United States Patent [19]

Chen

[11] Patent Number: 4,999,751

[45] Date of Patent: Mar. 12, 1991

[54] INNOVATIVE STRUCTURE OF CHRISTMAS LIGHT ASSEMBLY

[76] Inventor: Ming-Hsiung Chen, 7F, 16, Alley 3, Lane 227, Nung-An St., Taipei, Taiwan

[21] Appl. No.: 402,666

[22] Filed: Sep. 5, 1989

[51] Int. Cl.[5] ..... H01R 33/00

[52] U.S. Cl. ..... 362/226; 362/238; 439/356

[58] Field of Search ..... 362/238, 226, 249; 439/619, 356, 611

[56] References Cited

U.S. PATENT DOCUMENTS 2,984,813 5/1961 Bossi ..... 439/619 X 3,522,579 8/1970 Matsuya ..... 439/619

*Primary Examiner*—Stephen F. Husar

*Attorney, Agent, or Firm*—Ladas & Parry

[57] ABSTRACT

This invention relates to a Christmas light assembly and more particularly to the one which includes a lamp base comprising divided strips to flexibly match with the outer diameter of bulb so as to let bulb be firmly retained therein. The divided strips are having projecting inner wall portions with a longitudinal scoop channel set between each two projecting inner wall portions for draining of water. The lamp base also comprises two resilient hook members to respectively engage with the upper flange of a lamp holder when it is inserted therein, so as to reinforce the connection.

3 Claims, 3 Drawing Sheets

INNOVATIVE STRUCTURE OF CHRISTMAS LIGHT ASSEMBLY

BACKGROUND OF THE INVENTION

1. Field of The Invention

Christmas light sets are commonly used everywhere in the world during Christmas holidays, as an ornamental item either indoor or outdoor.

This invention is related to a kind of Christmas light assembly and more particularly to the one which is generally comprised of a lamp bulb set in a lamp base and firmly retained by a lamp holder.

2. Description of the Prior Art

Regular Christmas light assembly, as shown in FIG. 1, is generally comprised of a lamp bulb, a lamp base and a lamp holder. Drawbacks of regular Christmas light assembly may include the following:

(1) Because the tolerance of the outer diameter of the lamp bulb is normally set within about ±0.2 mm and the inner diameter of the lamp base must be large enough to receive the outer diameter of the lamp bulb, the lamp bulb may be not firmly retained in the lamp base, and the two conductive wires of the lamp bulb may be twisted to cause short-circuit.

(2) Because basic tolerance in size is inevitable and the plastic material tends to the deform following the change of temperature, the lamp base is easy to break away from the lamp holder.

It is therefore, the scope of the present invention to improve the said problems and to reduce percent defective in the production of Christmas light assembly.

SUMMARY OF THE INVENTION

The present invention is to provide an innovative structure of Christmas light assembly and more particularly the one which includes a lamp base received in a lamp holder. The lamp base is having a divided strip-like wall surface which may be squeezed to properly fit in with the actual outer diameter of bulb so as to let bulb be firmly retained by the lamp base. The lamp base also comprises two opposite hook members to respectively engage with the upper flange of the lamp holder such that the connection of the lamp base with the lamp holder is reinforced to prevent from breaking away from each other.

DETAILED DESCRIPTION OF THE PREFERRED EMBODIMENT

Figure 1:
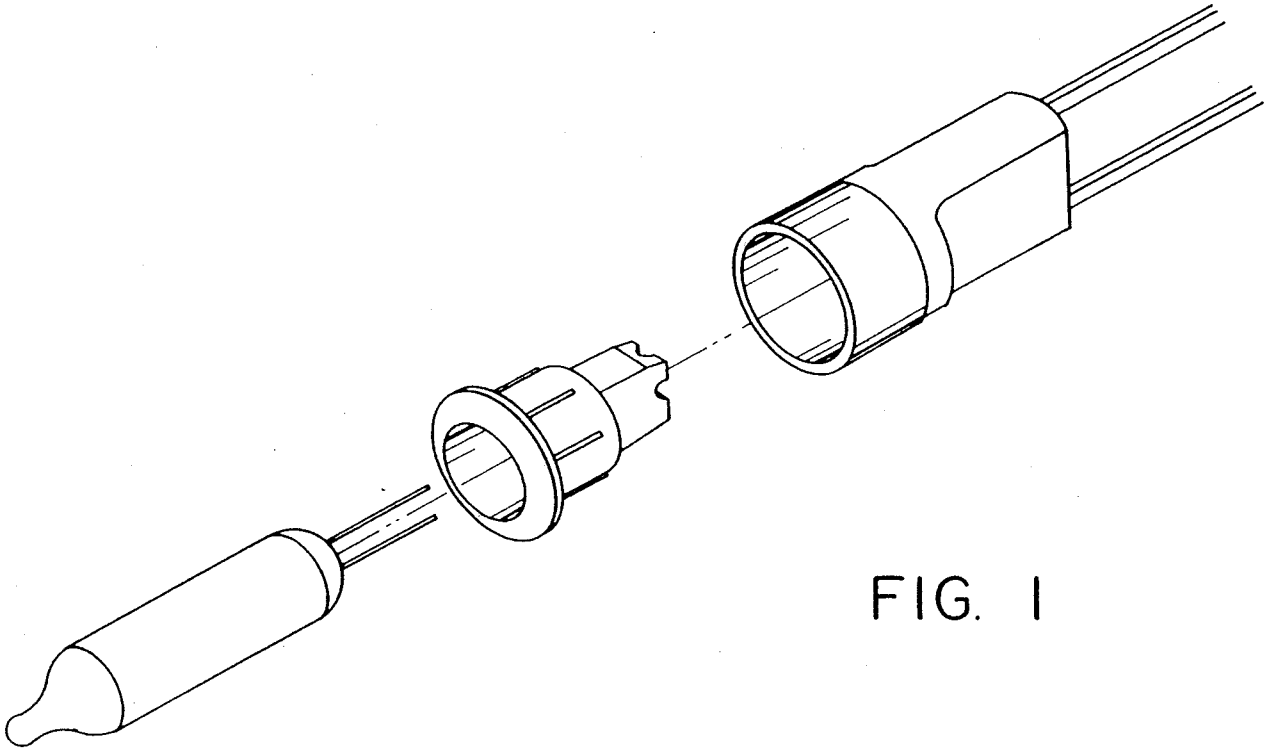
FIG. 1 is a perspective fragmentary view of the prior art.
Figures 2, 2A:
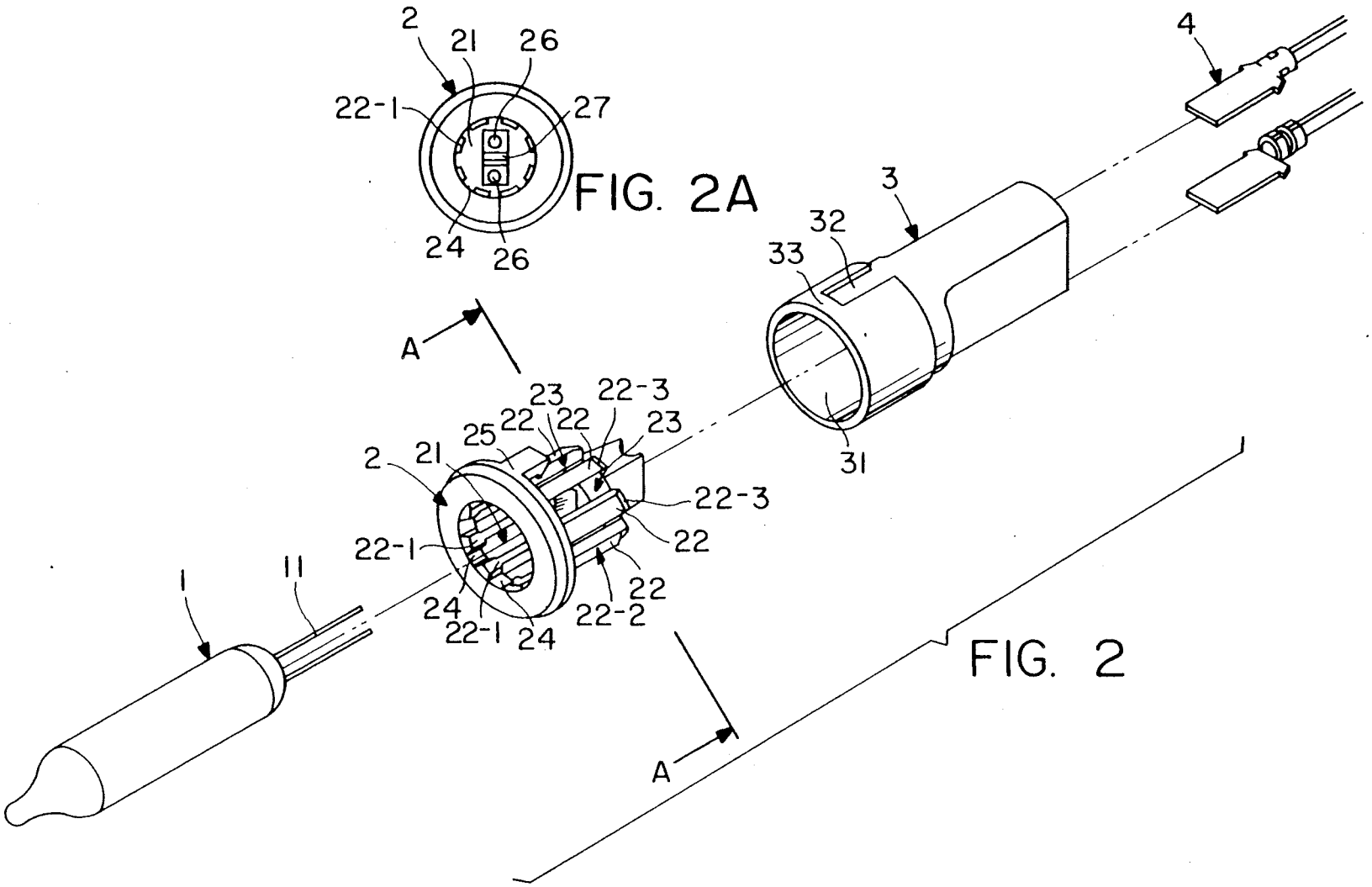
FIG. 2 is a perspective fragmentary view of a Christmas light assembly embodying the present invention.
FIG. 2A is a view from arrows A of FIG. 2.
Figure 4:
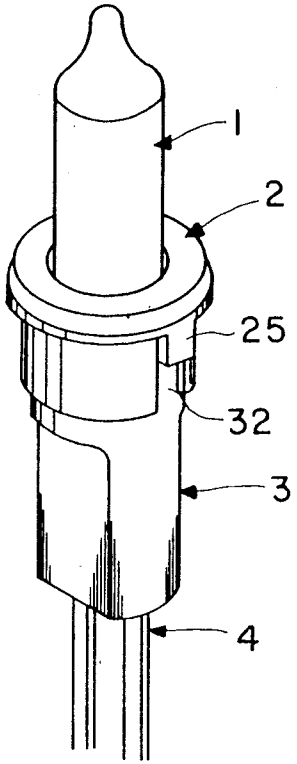
FIG. 4 is a perspective assembly view of the present invention.
Figure 3:
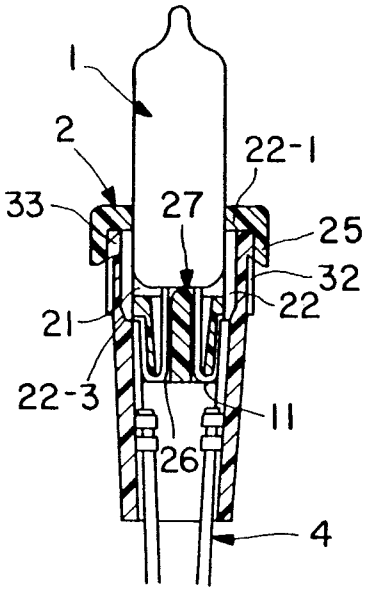
FIG. 3 is a sectional assembly view of the present invention.

Referring to FIGS. 2 through 4, therein illustrated is a Christmas light assembly of the present invention and generally comprised of a bulb 1, a lamp base 2, a lamp holder 3, and a pair of conductor terminals 4.

The lamp base 2 is comprising a plurality of divided strips 22 forming the circular wall portion defining therein an inner chamber 21 for receiving the bulb 1. When the bulb 1 is received in the lamp base 2 and the lamp base 2 is set in the lamp holder 3, the divided strips 22 may be properly squeezed to let the inner diameter of the inner chamber 21 be adjusted according to the actual outer diameter of the bulb 1 so as to let the bulb 1 be firmly retained by the lamp base 2. The divided strips 22 are spaced away from one another by means of a longitudinal groove 23 respectively, of which each is comprising a projecting inner wall portion 22-1 to facilitate insertion of the bulb 1 into the inner chamber 21. A longitudinal scoop channel 24 is respectively made between each two projecting inner wall portions 22-1 for draining of water. The outer wall portion 22-2 of each divided strip 22 is properly made to define an angle of inclination slope 22-3 to facilitate insertion of the lamp base 2 into the receiving chamber 31 of the lamp holder 3. The lamp base 2 also comprises two resilient hook members 25 integrally disposed at two opposite sides to respectively set in the two recesses 32 of the lamp holder 3 and engage with the flange 33. Through the engagement of the resilient hook members 25 with the flange 33, the lamp base 2 becomes firmly retained by the lamp holder 3 and does not break apart from the lamp holder 3 following any change of temperature. When the lamp base 2 is bent to a certain angle of inclination against the lamp holder 3 to let the two opposite hook members 25 disengage from the flange 33 of the lamp holder 3, the lamp base 2 can be easily removed from the lamp holder for replacement of the bulb 1.

As best as can be seen from FIG. 2A lamp base 2 is further comprising internally two through-holes 26 for insertion therein of the two conductive wires 11 of the bulb 1 respectively, and an elongated projecting block 27 between the two through-holes 26. When the bulb 1 is received in the lamp base 2 with the two conductive wires 11 respectively inserted into the two through-holes 26, the two conductive wires 11 of the bulb 1 are separated by the elongated projecting block 27 to prevent from short-circuit due to contact of the two conductive wires 11 with each other.

When the bulb 1 is set in the lamp base 2 and the lamp base 2 is received in the lamp holder 3, the pair of conductor terminals 4 are inserted into the receiving chamber of the lamp holder 3 to respectively connect with the two conductive wires 11 of the bulb 1 so as to let electric power be conducted to turn on the bulb 1.

What is claimed:

1. A Christmas light assembly, including:

a bulb with conductive wire ends set in a lamp base;

said lamp base being received in a lamp holder, said lamp base having an inner chamber comprising a plurality of divided strips forming a circular wall portion defining therein said inner chamber for receiving said bulb, and two resilient hook members integrally disposed at two opposite sides of said lamp base;

said lamp holder having an inner chamber for receiving said lamp base and comprising an upper flange; and a pair of conductor terminals inserted in said lamp holder to connect with the conductive wire ends of said bulb respectively for electric power conduction;

whereby when said bulb is received in said lamp base and said lamp base is set in said lamp holder, said divided strips are properly squeezed to let an inner diameter of the inner chamber of said lamp base be adjusted according to an actual outer diameter of said bulb to let said bulb be firmly retained by said lamp base, and said resilient hook members respectively engaged with said upper flange of said lamp holder to prevent said lamp base from separating from said lamp holder.

2. The Christmas light assembly according to claim 1, wherein said divided strips are spaced away from one another by means of a longitudinal groove respectively, each of said divided strips comprising respectively part of a projecting inner wall portion, and wherein a longitudinal scoop channel is respectively made between each two projecting inner wall portions of said divided strips for draining of water.

3. The Christmas light assembly according to claim 1, wherein said divided strips each have an outer wall portion defining an angle of inclination slope to facilitate insertion of said lamp base into the inner chamber of said lamp holder.

* * * * *